US008522582B2

(12) United States Patent
Keightley

(10) Patent No.: US 8,522,582 B2
(45) Date of Patent: Sep. 3, 2013

(54) DUAL LOCK APPARATUS

(76) Inventor: Kym John Keightley, Fairview Park (AU)

( * ) Notice: Subject to any disclaimer, the term of this patent is extended or adjusted under 35 U.S.C. 154(b) by 248 days.

(21) Appl. No.: 12/287,839

(22) Filed: Oct. 14, 2008

(65) Prior Publication Data

US 2009/0038353 A1 Feb. 12, 2009

Related U.S. Application Data

(63) Continuation of application No. 10/536,615, filed on Jan. 30, 2006, now abandoned, which is a continuation-in-part of application No. 10/276,574, filed on Nov. 14, 2002, now Pat. No. 6,964,183.

(30) Foreign Application Priority Data

| | | |
|---|---|---|
| May 18, 2000 | (AU) | 7576 |
| May 18, 2001 | (WO) | PCT/AU01/00579 |
| Nov. 29, 2002 | (AU) | 2002953027 |
| Dec. 1, 2003 | (WO) | PCT/AU03/001596 |

(51) Int. Cl.
*E05B 47/00* (2006.01)

(52) U.S. Cl.
USPC ..... 70/279.1; 70/278.2; 70/280

(58) Field of Classification Search
USPC ..... 70/93, 104, 106, 129, 134, 277, 278.2, 70/278.3, 278.7, 279.1, 280; 292/142, 144, 292/165, 172
See application file for complete search history.

(56) References Cited

U.S. PATENT DOCUMENTS

| | | | | |
|---|---|---|---|---|
| 5,044,184 | A * | 9/1991 | Herbers et al. | 70/277 |
| 5,083,448 | A * | 1/1992 | Karkkainen et al. | 70/277 |
| 5,199,288 | A * | 4/1993 | Merilainen et al. | 70/279.1 |
| 5,987,945 | A * | 11/1999 | Ruano Aramburu | 70/277 |
| 6,012,310 | A * | 1/2000 | Hsiao | 70/278.2 |
| 6,354,121 | B1 * | 3/2002 | Frolov | 70/277 |
| 6,418,763 | B1 * | 7/2002 | Huang | 70/278.7 |
| 6,546,769 | B2 * | 4/2003 | Miller et al. | 70/278.7 |
| 6,581,426 | B2 * | 6/2003 | Bates et al. | 70/278.7 |
| 6,612,141 | B2 * | 9/2003 | Bates et al. | 70/278.7 |
| 6,964,183 | B2 | 11/2005 | Keightley | |
| 6,983,962 | B2 * | 1/2006 | Keightley | 70/278.7 |
| 2005/0183480 | A1 * | 8/2005 | Hingston et al. | 70/279.1 |

FOREIGN PATENT DOCUMENTS

| | | |
|---|---|---|
| AU | 200017563 | 8/2000 |
| EP | 0 482 786 | 4/1992 |
| JP | 09-112091 | 4/1997 |

* cited by examiner

*Primary Examiner* — Christopher Boswell
(74) *Attorney, Agent, or Firm* — Sand & Sebolt

(57) ABSTRACT

The present invention relates to a dual lock apparatus (10) of the type including a locking bolt (14) moveable between a first locked position and a second unlocked position said bolt movement corresponding with longitudinal movement of a slider (26) said apparatus including a first and a second locking means adapted to operate independently of one another. The first locking means (74) includes a rotatable cam (76) such that when rotated said cam acts against a moveable piston to thereby move said piston from a first position to a second position in which the second locking means becomes disengaged from said slider and further rotation of the cam urges longitudinal movement of the slider. The second locking means includes an electric motor in geared connection to a member (44) moveable between a first position and second position corresponding with the locked and unlocked positions of the bolt said member including an outwardly biased pin (52) adapted to engage the piston cylinder (58) and urge said piston into said piston first position to thereby mechanically connect the second locking means with the slider. The locking means can therefore operate independently of one another.

11 Claims, 7 Drawing Sheets

DUAL LOCK APPARATUS

CROSS-REFERENCE TO RELATED APPLICATIONS

This is a Continuation of U.S. application Ser. No. 10/536,615, filed May 26, 2005, which is the National Stage of International Application No. PCT/AU03/01596, filed Dec. 1, 2003, which claims the benefit of Australian Application Serial No. AU 2002953027, filed Nov. 29, 2002; and is a Continuation-in-Part of U.S. application Ser. No. 10/276,547, filed Nov. 14, 2002 and now U.S. Pat. No. 6,964,183, which is the National Stage of International Application No. PCT/AU01/00579, filed May 18, 2001, which claims the benefit of Australian Application No. PQ7576, filed May 18, 2000.

BACKGROUND OF THE INVENTION

1. Technical Field

The present invention relates to a dual lock apparatus, and in particular, to a dual lock apparatus that has at least two independent means of acting on a lock whereby operation of the two locking means is controlled by an improved clutch mechanism.

2. Background Information

In a previous patent by the same applicant (PCT/AU01/00579 entitled 'A Dual Lock Apparatus'), whose contents are expressly incorporated by reference herein, there was disclosed a locking apparatus having at least two independent means of acting on a lock. Although the apparatus as described in the aforementioned patent has been found to function satisfactorily, an improved clutch mechanism which allows the two locking mechanisms to function independently has been developed and is the subject of the present application.

There are numerous types of locks in existence today that are used to secure various devices. One of the more common uses of locks is in relation to doors. Typically door locks have a bolt that can be extended from a locking mechanism so as to engage a doorframe or furniture with the bolts being driven by the use of a unique or slave key. There have also been developed locks that are not only operable by the use of the slave key but also a master key, allowing the master key holder, for example, to operate all doors in a pre-defined area whilst the slave key holders are limited to being able to operate specific doors only. This however requires the master key and the slave key to be of the same type thus potentially compromising security.

There have also been developed electromechanical locks that use an electric motor to drive the bolt. The difficulty with these types of arrangements is that if the electric motor was for whatever reason inoperable, the door may be left either in the unlocked or locked state and may require disassembly to be fixed.

Further still, the difficulty with some existing locks is that although the door may be unlocked, that is it may be opened, the bolt still engages a portion of the door frame and further manual operation of the bolt by the use of a handle is required to be able to open the door. On the other hand, if the bolt was to be retracted fully, then the door may swing freely, also an undesirable effect.

It is an object of the present invention to propose a locking apparatus that overcomes at least some of the abovementioned problems or provides the public with a useful alternative.

Although the present specification discusses doors in particular it is to be understood that the present invention is not intended to be limited to doors and may equally well be used to provide a locking apparatus in relation to other devices such as safes and gates to name but two.

SUMMARY OF THE INVENTION

In one form of the invention there is proposed a dual lock apparatus of the type including a lock moveable between a first position whereby said lock extends outwardly from said apparatus and a second position whereby said lock is contained within said apparatus said apparatus including:

a slider movable between a first position and a second position and including a first end associated with said lock such that movement of the slider causes corresponding movement of the lock, and a second end associated with a first locking means and a second locking means whereby independent operation of said first and second locking means is controlled by a clutch mechanism;

said clutch mechanism including an aperture which extends through said slider and a piston movable between at least a first and second position within said slider aperture;

said second locking means including a member movable between a first and a second position said member including an outwardly biased locking member adapted to engage said slider aperture to thereby mechanically connect said second locking means with said slider to thereby effect movement of said slider upon movement of said member;

said first locking means including a rotatable cam such that when rotated said cam acts against said piston to thereby move said piston from said first position to said second position to thereby mechanically connect said first locking means with said slider to thereby effect movement of said slider.

Preferably said first locking means disengages said second locking means.

This allows independent operation of said first locking means with respect to said second locking means.

The above provides the advantage that if the second locking means is one that may be exposed to potential failure, the first locking means ensures that there is a safeguard in that the lock can always be operated even if the secondary locking means has ceased to function.

Advantageously at least one of said locking means is electrically driven. Advantageously said first locking means is a key activated locking means whilst said second locking means is an electromechanical locking means.

Preferably both said first and second locking means are key activated.

A particularly apt use of this invention is in the case where the electromechanical locking means is controlled by remote activation of an electric motor. If for whatever reason the electric motor were to fail, such as a power failure, then the primary locking mechanism that is operated for example by a key may be used to unlock or lock the lock.

Advantageously when said slider interacts with said locking bolt so as to move it into said first position, said slider resists withdrawal of said locking bolt.

In a further form of the invention there is proposed a dual lock apparatus of the type including a locking bolt moveable between a first position extending outwardly from said apparatus to engage with an external restraining means and a second position to be contained within said casing said apparatus including:

a slider adapted to interact with said locking bolt so as to move it into said first or second position said slider including at one end an aperture extending perpendicularly to the direction of motion of said slider said aperture adapted to house a slider abutment member;

said slider abutment member being moveable between a first position whereby a surface of said member is flush with a surface of said slider and a second position whereby said surface of said member is housed within said aperture;

a carriage associated with said slider said carriage including an abutment surface said carriage further being moveable between a first position wherein said slider is located in said slider second position, and a second position thereby urging said slider into said slider first position;

a first locking means having a rotatable cam means such that when rotated in a first direction so as to act against said carriage abutment surface urges said carriage into said carriage second position and said abutment member into said first position to thereby urge the slider towards its first position and thereby outwardly extend said bolt and when said cam is rotated in an opposite direction it acts to thereby urge the slider towards its second position to thereby inwardly retract said bolt;

a second locking means adapted to be activated independent of said first locking means including a rack associated with said slider and movable between a first position whereby said bolt is inwardly retracted and a second position whereby said bolt is outwardly extended, said member including an outwardly biased pin housed within a rack cavity and movable between a first and a second position, in said first position said pin engaging with said slider aperture to thereby effectively mechanically couple said second locking means to said slider and thus the bolt and in said second position said pin forced into said cavity whereby said slider may freely move to thereby effectively decouple said second locking means from the slider, this occurring when said slider abutment member is in said member first position.

Preferably when said cam discontinues urging of said carriage, a biasing member acts upon said pin to return it to said first position upon alignment of said pin and said slider aperture.

BRIEF DESCRIPTION OF THE DRAWINGS

The accompanying drawings, which are incorporated in and constitute a part of this specification, illustrate several implementations or embodiments of the invention and, together with the description, serve to explain the advantages and principles of the invention. In the drawings.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The present invention relates to locks and in particular to locks that are used for hollow winged aluminium doors and the like. It may also be adapted to be used on other type of doors such as sliding doors. It is not intended to limit the invention to any particular type of lock or door.

Figure 1:
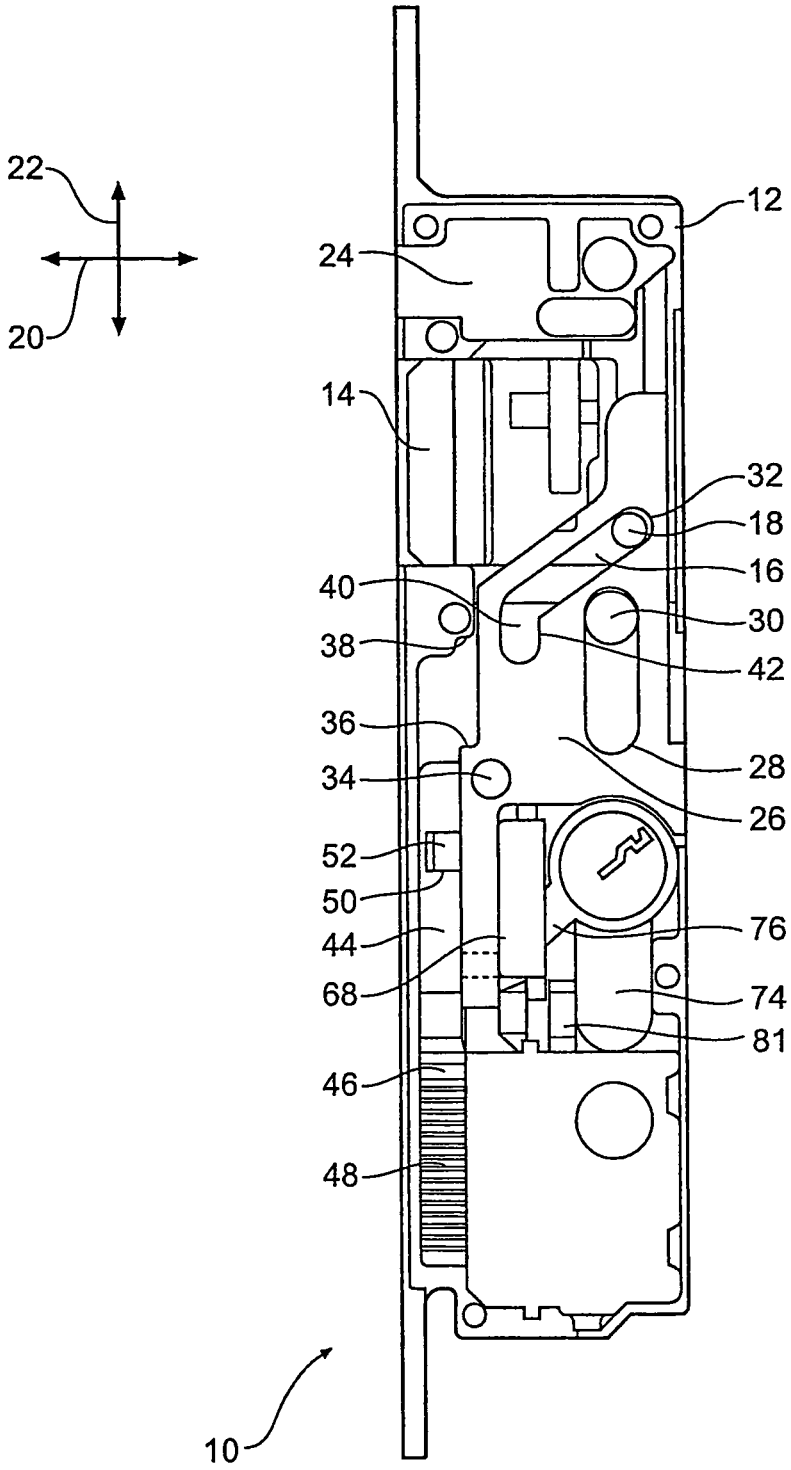
FIG. 1 is a top view of the internal components of a lock in an unlocked configuration and including the lock slider body of the present invention.
Figure 2:
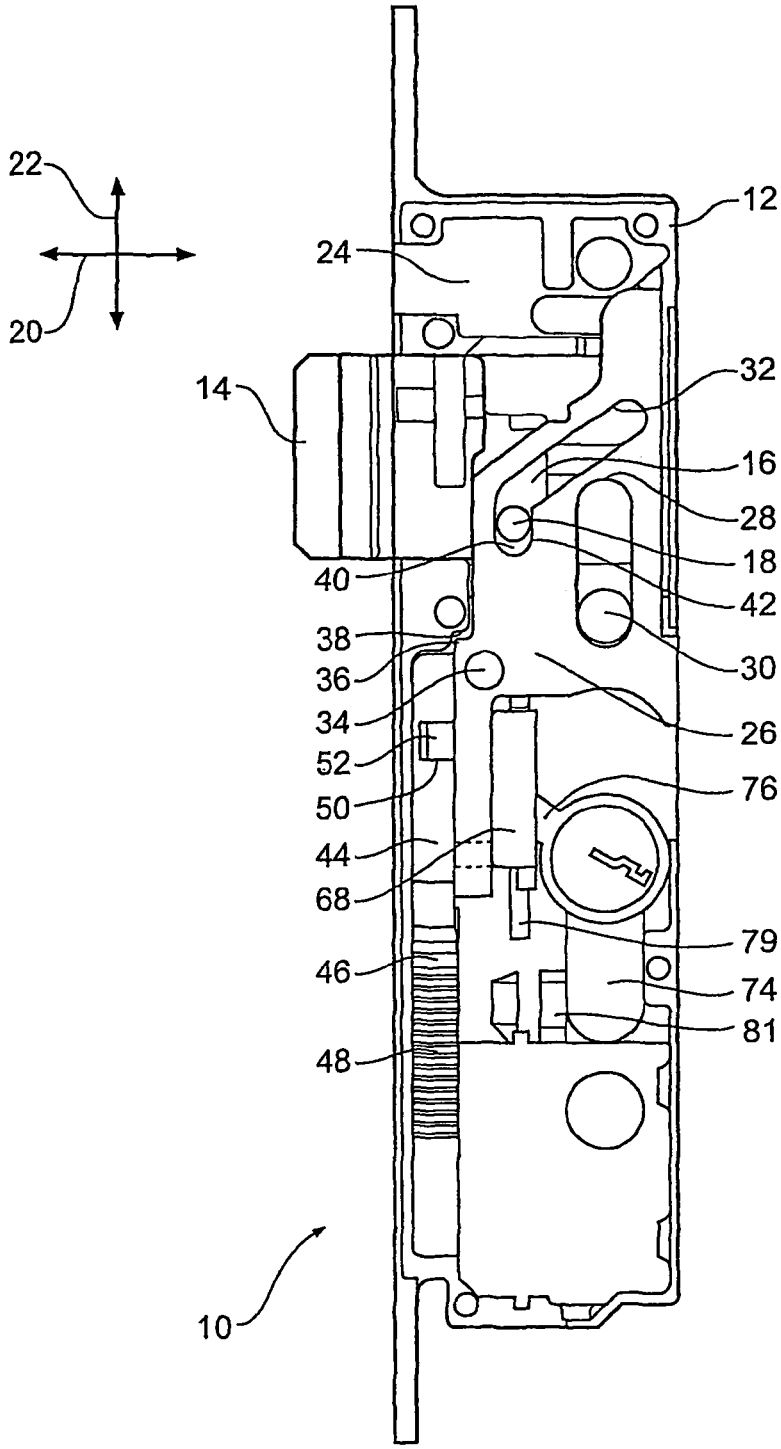
FIG. 2 is a top view of the internal components of the lock of FIG. 1 in a locked configuration using a secondary locking mechanism, more specifically, an electric motor and rack system.

Shown in FIGS. 1 and 2 is a dual lock 10 in accordance with the present invention, FIG. 1 illustrating the lock 10 in its unlocked state and FIG. 2 showing the lock 10 in its locked state. FIGS. 1 and 2 illustrate the use of a secondary locking mechanism, generally indicated at 99, that is, the use of an electric motor 100 to lock or unlock the lock 10 and which will be described hereinbelow. The primary locking mechanism, which is slightly more complex, will also be described.

A casing 12 is adapted to slidingly support a locking bolt 14 said bolt 14 being biased outwardly from said casing 12 by the use of a spring (not shown). The bolt 14 includes a sunken shoulder 16 at one side of the bolt rear end, said shoulder supporting an annular projection 18. The bolt 14 is adapted to slide generally in a perpendicular axis 20 to the longitudinal axis 22 of the casing 12. A lock case 24 limits the outward movement of said bolt.

A slider 26 is adapted to slide along the longitudinal direction 22 within the casing 12 and includes a first longitudinal slit 28 engaging a screw 30, the screw 30 providing holding support for the lock 10.

The slider 26 includes a second slit 32 extending at an inclined direction to both the perpendicular and the longitudinal axis 20 and 22 respectively. Slit 32 engages projection 18 of the shoulder 16. One can thus appreciate that when the slider is moved towards the bolt, the inclination of the slit 32 causes the bolt 14 to be extended outwardly from said casing 12. Conversely, when the slider 26 is moved in a direction away from the bolt 14, the slit 32 acting on the shoulder projection 18 urges the bolt 14 to be withdrawn into the casing 12. When locked, the slider 26 is maintained through use of a biasing member 34, which may be indexed with a recess in the lid (not shown), for example.

The slider 26 may further include a shoulder 36 adapted to abut against face 38 in the casing 12 to act as a dead stop for the slider motion.

The end of the slit 32 where the bolt is caused to extend out of said casing includes a hooked portion 40 where the slit extends in a longitudinal direction parallel to the casing and thus perpendicular to the movement of the bolt. This has the advantage that when the projection 18 is located within the hooked location 40, the slider effectively deadbolts the bolt. That is, if the bolt experiences an inward force, the edge 42 of the hooked portion 40 of the slit 32 engages the projection 18 and prevents the bolt 14 from moving into the casing 12. To keep the projection steady within the hooked portion the slit may include a slight annular recess (not shown).

It is the slider 26 that provides the motion for the movement of the bolt 14 into and outward of the casing 12. To enable the slider 26 to be movable by both the primary (key) and secondary (electric motor) locking mechanisms requires a clutch mechanism that is now described.

Figure 3:
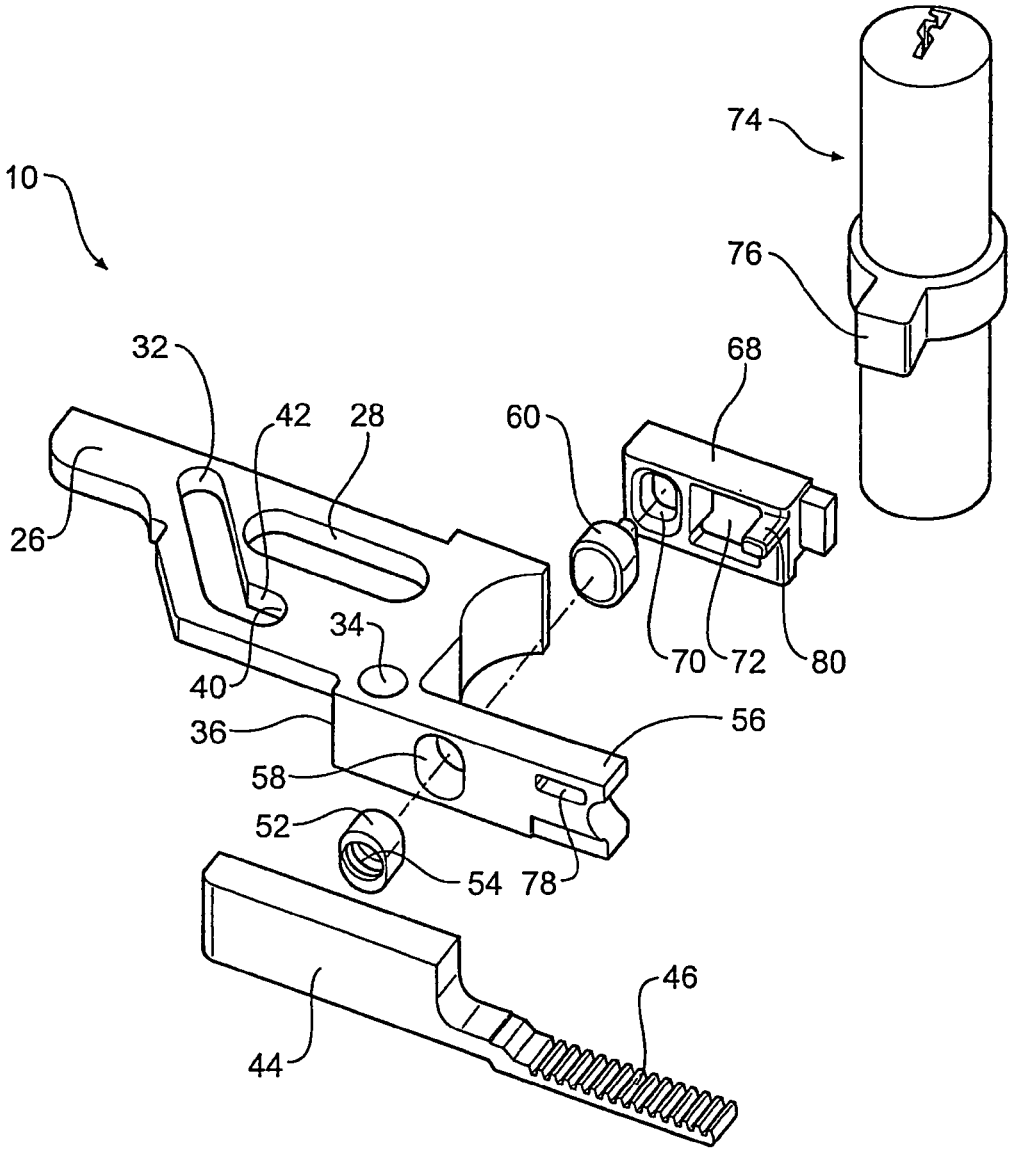
FIG. 3 is an exploded perspective view of the different components of the lock of FIG. 1.
Figure 4:
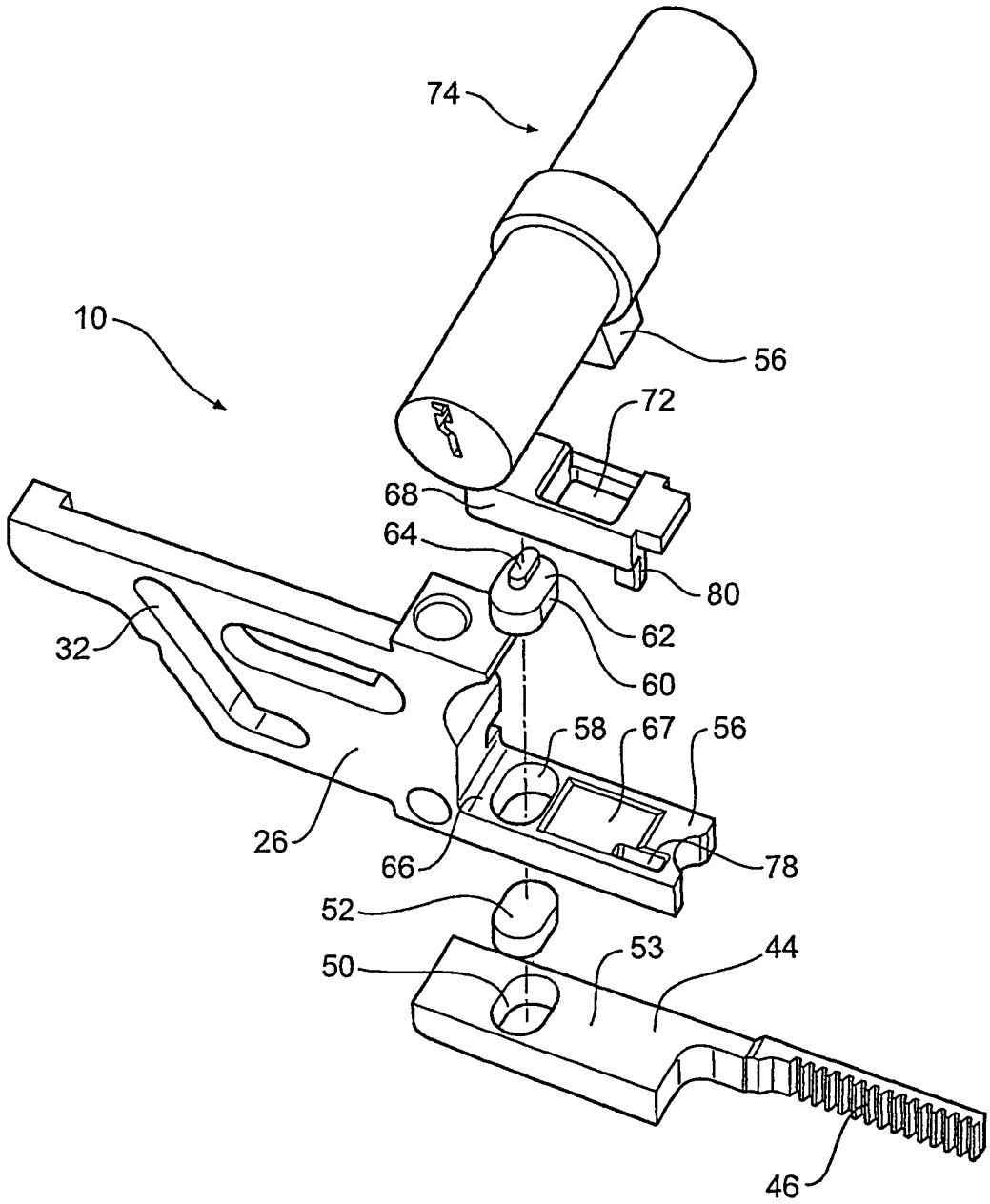
FIG. 4 is an alternate exploded perspective view of the different components of the lock of FIG. 1.
Figure 5:
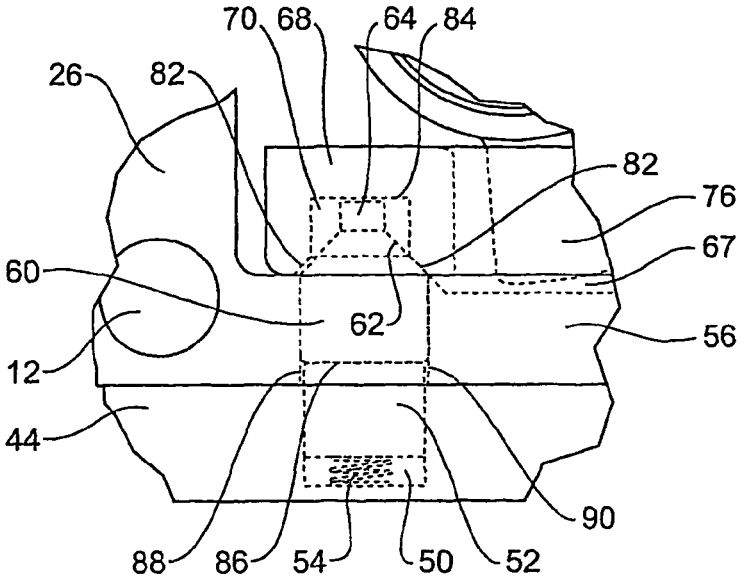
FIG. 5 is a cross-sectional view of the main component of the lock of FIG. 1 whereby the secondary locking mechanism is used to lock the bolt.

The secondary locking means includes a rack 44 that is adapted to engage the slider 26. The rack 44 includes at one end splines 46 that are driven by a gear 48 rotatably driven by a shaft 102 extending from the electric motor 100. The other end of the rack includes a generally oval-shaped cavity 50 which extends only partially therethrough. An outwardly biased pin 52 is positioned within the cavity 50 such that in its rest position, it extends beyond 53 of the rack 44. The pin 52 contains a recess for housing the biasing member which in this case is a spring 54. These parts of the lock can be seen more clearly in the exploded views of FIGS. 3-4.

The slider 26 further includes an arm 56 with an aperture 58 extending therethrough. The aperture 58 is generally of the same shape as cavity 50 in rack 44. Housed within aperture 58 is a cap 60 including a tapered shoulder 62 terminating into a head 64. It should therefore be apparent that when aperture 58 and cavity 50 are coaxially aligned, pin 52 will be pushed through aperture 58 and abut the lower surface of cap 60. Arm 56 includes a recess 67 to allow for movement corresponding with the primary locking mechanism which will be later explained.

Further included is a carriage 68. Carriage 68 includes a carriage pocket 70 and carriage aperture 72 extending therethrough. A lock barrel or cylinder 74 rotatably fixed to the casing 12 includes a cam 76 that upon rotation of the key barrel is correspondingly rotated. The cam 76 is adapted to be housed within carriage aperture 72 and during the locking and unlocking processes, the cam 76 correspondingly follows the movement of the carriage 68. It is during this process that recess 67 is required to allow for the cam rotation. Carriage 68 is shiftable along slider 26 to the extent provided by a locking cavity 78 on arm position. As there is no force provided by cam 76, the cap 60 remains in the central position of the pocket 70 thereby allowing pin 52 to constantly abut surface 88. Then, on operation of the electric motor to unlock the bolt 14, the pin 52 acts on surface 90 of slider aperture 58 to shift the slider 26 in the opposite direction.

One can thus appreciate that the above operation, in using a secondary locking mechanism, is capable of locking and unlocking the lock 10 independent of the primary locking mechanism, that being operative use of the cam 76.

Figure 6:
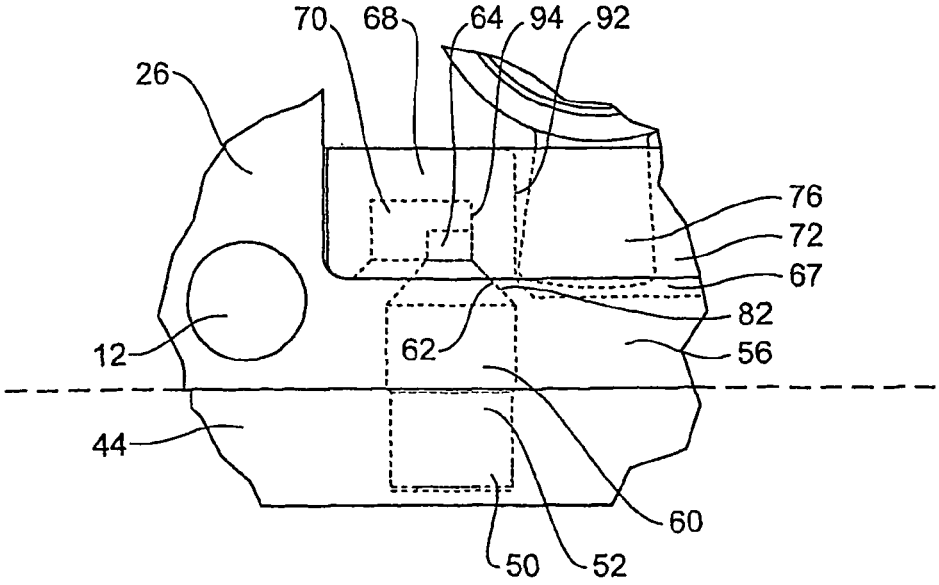
FIG. 6 is a cross-sectional view of the main component of the lock of FIG. 1 whereby a primary locking mechanism (a key operated cam) disengages the secondary locking mechanism.
Figure 7:
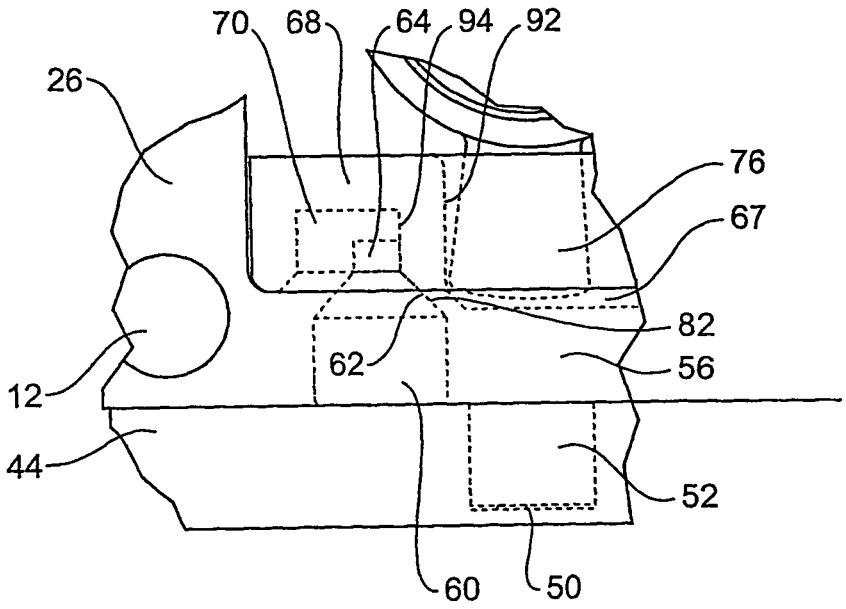
FIG. 7 is a cross-sectional view of the lock as in FIG. 6 whereby the primary locking mechanism is used to lock the bolt subsequent to disengagement of the secondary locking mechanism.
Figure 8:
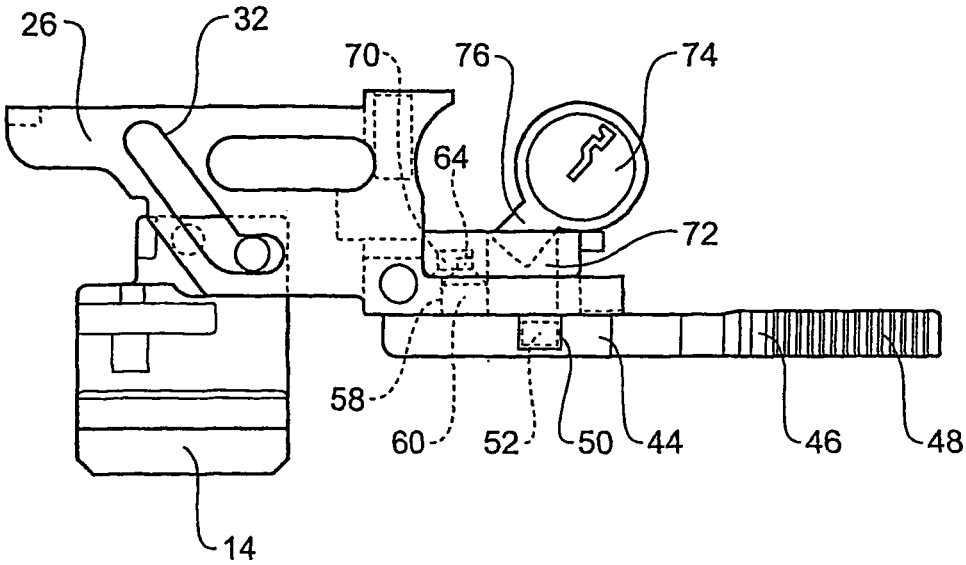
FIG. 8 is a cross-sectional view of the main components of the lock of FIG. 1 whereby the lock is in its fully locked state using the primary locking mechanism.
Figure 9:
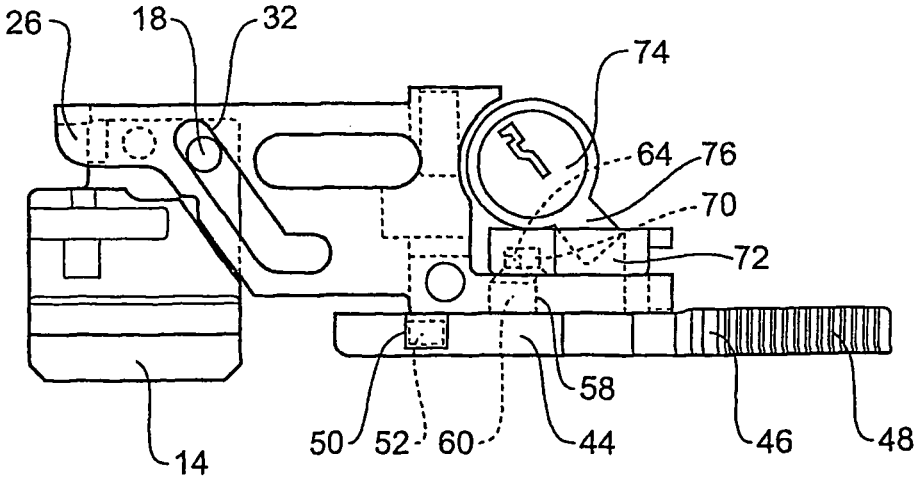
FIG. 9 is a cross-sectional view of the main components of the lock of FIG. 1 whereby the lock is in its fully unlocked state using the primary locking mechanism.

FIGS. 6-9 illustrate the primary locking mechanism which involves the use of a key being inserted into the key barrel and rotated, thereby rotating cam 76. More specifically, FIG. 6 illustrates the way the primary locking mechanism may function while the secondary locking mechanism is disengaged, FIG. 7 illustrates a continuation of this same locking action, while FIGS. 8 and 9 illustrate the fully locked and fully unlocked configurations of the lock 10 respectively.

Those skilled in the art would appreciate that when cam 76 is rotated in order to lock the lock 10, it is caused to abut surface 92 of carriage aperture 72. Therefore, carriage 68 is forced to longitudinally shift relative to the slider 26. As can be seen in FIG. 6, this action causes tapered surface 82 of carriage pocket 70 to push against tapered shoulder 62 of cap 60. Cap 60 is forced into its carriage frame and the tapered surfaces continue to slide until the side of head 64 of cap 60 abuts with surface 94 of pocket 70. This action not only causes pin 52 to be forced into cavity 50 due to the force applied by cap 60, but also provides for a mechanical connection between the cam 76 and the slider 26 to thereby shift the slider 26 with further rotation of the cam 76. Essentially, connection between the slider 26 and rack 44 is broken due to the resulting shear plane between rack and slider while connection between slider 26 and cam 76 is achieved.

With continued rotation of the cam 76, the bolt is drawn into the extended and deadlocked position. It is to be understood that the deadlocked configuration of the bolt 14 is not achieved through the primary locking mechanism but rather through pocket 40. If the primary locking mechanism did involve its own deadlocking feature, unlocking the bolt 14 using the secondary locking mechanism would not be possible. It should therefore be clear that the present invention provides for two independent means of locking and unlocking bolt 14.

When unlocking lock 10, which is to drive bolt 14 within the casing 12, the key is obviously rotated in the opposite direction. Therefore, cam 76 is forced to abut with surface 96 of carriage aperture 72 thereby causing carriage 68 to shift in the opposite direction as described above, with the cap 64 forced to abut the opposite surface of carriage pocket 70.

In the situation where the bolt has been unlocked using the primary locking mechanism and is required to be locked once again using the secondary locking mechanism, the electric motor when operated will drive the rack until the rack cavity 50 is coaxially aligned once again with slider aperture 58 such that spring 54 forces pin 52 back into abutment with cap 60 such that the slider 26 and rack 44 are now re-coupled for the electric motor to drive the lock.

One can thus appreciate how the present invention may be used to unlock a lock that has been locked by an electric motor that is still in the locked position. This is advantageous where the electric lock is to be overridden or where it has broken down. Use of the primary locking mechanism thus allows the lock to still operate even where the electric motor can no longer function.

It is to be understood that once the secondary locking mechanism has been disengaged, it remains motionless due to the gearing of the electric motor. Essentially, gearing back movement is prevented and thereby allows sufficient force to be applied to the slider to overcome tension that may be acting on the slider due to pin 52 which remains outwardly biased.

In a further aspect of the invention, the actions of the electric motor may well be governed by the use of a microprocessor in electrical connection with both the electrical motor and an arrangement of micro-switches which sense whether the slider is in a locked or unlocked position. The primary function of the processor is to process information gained from the micro-switches and to correspondingly operate the electric motor. One advantage to such a system over existing systems is that there is no longer the requirement for operating the motor for a predetermined amount of time to ensure that locking or unlocking has taken place and considerable battery power consumed in the process.

If under any circumstances the lock should fail to lock, the processor will realize that the lock is neither in a locked or unlocked state and sound an audible alarm to inform the user that the lock has not been successfully locked.

Further, the apparatus may well include a remote access means such as an infrared receiver such that locking and unlocking of the lock may be achieved from a remote location using a transmitting means. Further still, the apparatus may include an interrogation means so that a user may determine whether the bolt is in a locked or an unlocked position some distance away.

In some circumstances, a further bolt system may be engaged simultaneously with the dual lock of the present invention whereby the apparatus is in mechanical connection with one or more further bolts used to lock or unlock the door whereby the slider 28 is in mechanical connection with the bolts.

So as to keep the door from freely swinging when in the unlocked position, the lock mechanism may include a spring-loaded latch (not shown) being outwardly biased by a biasing means (not shown).

It is to be understood that other secondary driving means may equally well be employed. The rack may be acted upon by use of a manually operated crank (not shown).

In general the term deadlocking is intended to mean that when the lock is deadbolted, that the slider is effectively prevented from any slidable motion.

The above description generally referred to the slider being movable by a key activating the primary locking mechanism and an electric servomotor driving the secondary locking mechanism. It may equally well be, however, that the secondary locking mechanism is also activated by the use of a solenoid. However the electric motor provides much higher torques required especially where the lock arrangement includes multiple bolts such as additional upper and lower bolts. Even further still the secondary locking mechanism may also include a key activated lock accessible from one or both sides of the lock case or other types of simple non-secure actuators.

The present invention may also equally well be adapted for use on existing doors by the use of simple but effective adaptive pieces.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

The invention claimed is:

1. A dual lock apparatus of the type including a locking bolt moveable along a lateral bolt axis between a first position where said locking bolt extends outwardly from said apparatus and a second position where said locking bolt is contained within said apparatus, said apparatus including:

a slider moveable between a first position and a second position along a longitudinal axis disposed transverse to the bolt axis, said slider including a first end associated with said locking bolt such that movement of the slider causes corresponding movement of the locking bolt, and a second end associated with a key lock and a motor lock where independent operation of the key lock and the motor lock is controlled by a clutch mechanism; said clutch mechanism including an aperture which extends laterally through said slider parallel to the bolt axis and a coupling member moveable laterally between at least a first and second position within said slider aperture; wherein said slider includes a longitudinally extending arm and a slider carriage disposed in abutting contact with a side wall of the arm and being movable longitudinally along said side wall; said slider aperture being defined in the arm and the slider carriage defining a carriage pocket alignable with the slider aperture and configured to receive a portion of the coupling member therein; and said slider carriage further defines a carriage aperture extending laterally therethrough; and wherein the side wall of the arm further defines a locking cavity therein and the slider carriage includes a projection that extends outwardly from the carriage and is received in the locking cavity; and movement of the slider carriage along said side wall is limited by the longitudinal travel of the projection in the locking cavity;

said motor lock including a slidable member moveable longitudinally between a first and second position, said slidable member including an outwardly biased locking member adapted to engage said slider aperture to thereby mechanically connect said motor lock with said slider to thereby effect movement of said slider upon movement of said slidable member; and said key lock including a rotatable cam that is engaged with the slider such that, when rotated, said cam acts against said coupling member to move said coupling member from said first position to said second position and thereby mechanically connect the key lock with said slider to thereby effect movement of said slider; and wherein said cam is always received in said carriage aperture.

2. The dual lock apparatus as in claim 1, wherein the key lock disengages said motor lock.

3. The dual lock apparatus as in claim 1, wherein when said key lock has locked said locking bolt, said motor lock is actuatable to unlock said locking bolt.

4. The dual lock apparatus as in claim 1, wherein said motor lock is electrically driven.

5. The dual lock apparatus as in claim 1, wherein said key lock is a key activated locking means whilst said motor lock is an electromechanical locking means.

6. The dual lock apparatus as in claim 1, wherein both the key lock and the motor lock are key activated.

7. The dual lock apparatus as in claim 1, wherein when said slider interacts with said locking bolt so as to move it into said first position, said slider resists withdrawal of said locking bolt.

8. The dual lock apparatus as in claim 1, further comprising a biasing member and wherein when said cam discontinues urging of said carriage, said biasing member acts upon said pin to return it to said first position upon alignment of said pin and said slider aperture.

9. The dual lock apparatus as in claim 1, wherein the locking bolt is able to be retracted inwardly by the motor lock both when the locking bolt has been both extended outwardly by the motor lock and when the locking bolt has been extended outwardly by the key lock.

10. The dual lock apparatus as in claim 1, wherein the rotatable cam is always engaged with the slider.

11. The dual lock apparatus as defined in claim 1, wherein said motor lock is able to effect movement in the slider between the second and first slider positions when the slider has been moved into the first slider position by the key locking means and by the motor lock.

* * * * *